United States Patent [19]

De Rush

[11] Patent Number: 4,862,721

[45] Date of Patent: Sep. 5, 1989

[54] MULTIPLE CYLINDER EXTRUSION APPARATUS AND METHOD

[75] Inventor: Michael J. De Rush, Mt. Clemens, Mich.

[73] Assignee: Hydramet American, Inc., Royal Oak, Mich.

[21] Appl. No.: 156,284

[22] Filed: Feb. 16, 1988

[51] Int. Cl.[4] ..... B21C 27/04; B21C 33/00

[52] U.S. Cl. ..... 72/263; 72/38; 72/272

[58] Field of Search ..... 72/38, 263, 272

[56] References Cited

U.S. PATENT DOCUMENTS

| | | | |
|---|---|---|---|
| 1,825,343 | 9/1931 | Evans | 72/263 |
| 3,025,959 | 3/1962 | Poleschuk | 72/263 |
| 3,182,478 | 5/1965 | Asari | 72/263 |
| 3,898,831 | 8/1975 | Kahlefeld | 72/263 |

FOREIGN PATENT DOCUMENTS

| | | | |
|---|---|---|---|
| 660941 | 7/1929 | France | 72/263 |
| 2298379 | 8/1976 | France | 72/38 |
| 2613 | 2/1979 | Japan | 72/38 |
| 804220 | 11/1958 | United Kingdom | 72/263 |

*Primary Examiner*—Robert L. Spruill

*Attorney, Agent, or Firm*—Barnes, Kisselle, Raisch, Choate, Whittemore & Hulbert

[57] ABSTRACT

A structure comprised of a plurality of material cylinders, a ram head or heads for extrusion, and a mechanism for transferring the material cylinders into alignment with a ram head. The plural cylinders allow an operator to manually load one cylinder of a pair with extrusion material in preparation for an extrusion phase on that cylinder, while the other cylinder of the pair is being discharged by a suitable ram piston in the extrusion phase. A special de-airing mechanism is provided and a lateral shift system to align the respective cylinder selectively with a power extrusion ram. More than one pair of cylinders can be utilized.

3 Claims, 3 Drawing Sheets

MULTIPLE CYLINDER EXTRUSION APPARATUS AND METHOD

FIELD OF INVENTION

This invention relates to an extrusion apparatus, and more particularly an extrusion press which comprises a structure which is pivotably mounted for movement between horizontal through vertical positions.

BACKGROUND AND SUMMARY OF THE INVENTION

Extrusion is a time-consuming process of loading material into a cylinder, vacuuming air out of the cylinder, and slowly extending a ram into the loaded material cylinder to extrude the material out through a die. An operator who has loaded the material will be idle until the extrusion cycle is completed. To reduce idle time of the operator, two machines might be placed on either side of the operator to be alternately loaded. Still, production is inefficient because during the loading of the material cylinder, the machine is idle until the operator has completed loading.

In addition, there are problems with the supporting and removal of the extrusion as the machine cycle is completed. Extrusions vary in shape and in material composition. Some of the extrusions require special handling during the extrusion process because of the brittle nature of its material composition or the thin wall design of its shape. Some will require gravity to assist in the extrusion through the die. Extrusion apparatuses of this nature are disclosed in U.S. Pat. Nos. 3,638,469 and 3,898,831.

The object of the present invention is to provide an increase in production of the extruded product and make efficient use of the operator's time by providing for manual or automatic loading of an empty material cylinder at the same time the press extrudes material from the other material cylinder.

Another object of the invention relates to the incorporation into the improved apparatus of a de-airing mechanism which allows access for cleaning of the piston assembly with each cycle of the extruder if required. Similarly, the improved apparatus allows the use of angle locations of the extrusion cylinder for successful unloading of the extruded material to prevent damage.

Other objects and features of the invention will be apparent in the following description and claims in which the principles of the invention are set forth together with details to enable persons skilled in the art to which the invention pertains to practice the invention all in connection with the best mode presently contemplated for the invention.

BRIEF DESCRIPTION OF THE DRAWINGS

Drawings accompany this disclosure and the various views thereof may be described as follows.

DETAILED DESCRIPTION OF PREFERRED EMBODIMENTS

Figure 1:
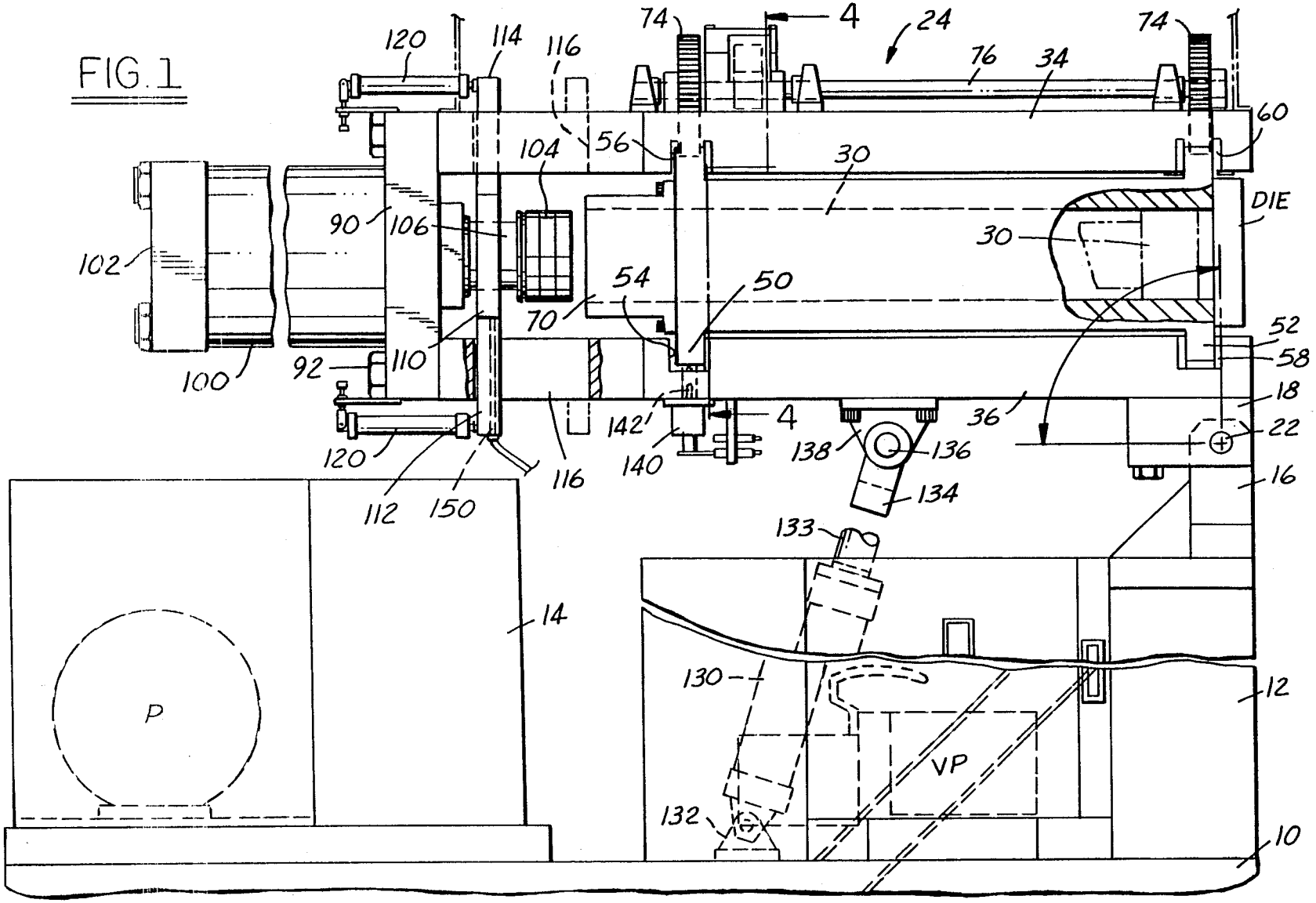
FIG. 1, a side elevational view of the apparatus of this invention with portions broken away for purposes of illustration.

With reference to the drawings, a base 10 mounts a housing 12 which encloses an actuating cylinder and a pump to be later described. Adjacent the housing 12 is a second housing 14 forming a tank for hydraulic actuating fluid. On one end of the housing 12 are two upstanding brackets 16 which pivotably mount bifurcate supports 18 transfixed by pivot pin 20 on an axis 22 (FIGS. 1 and 3).

Figure 2:
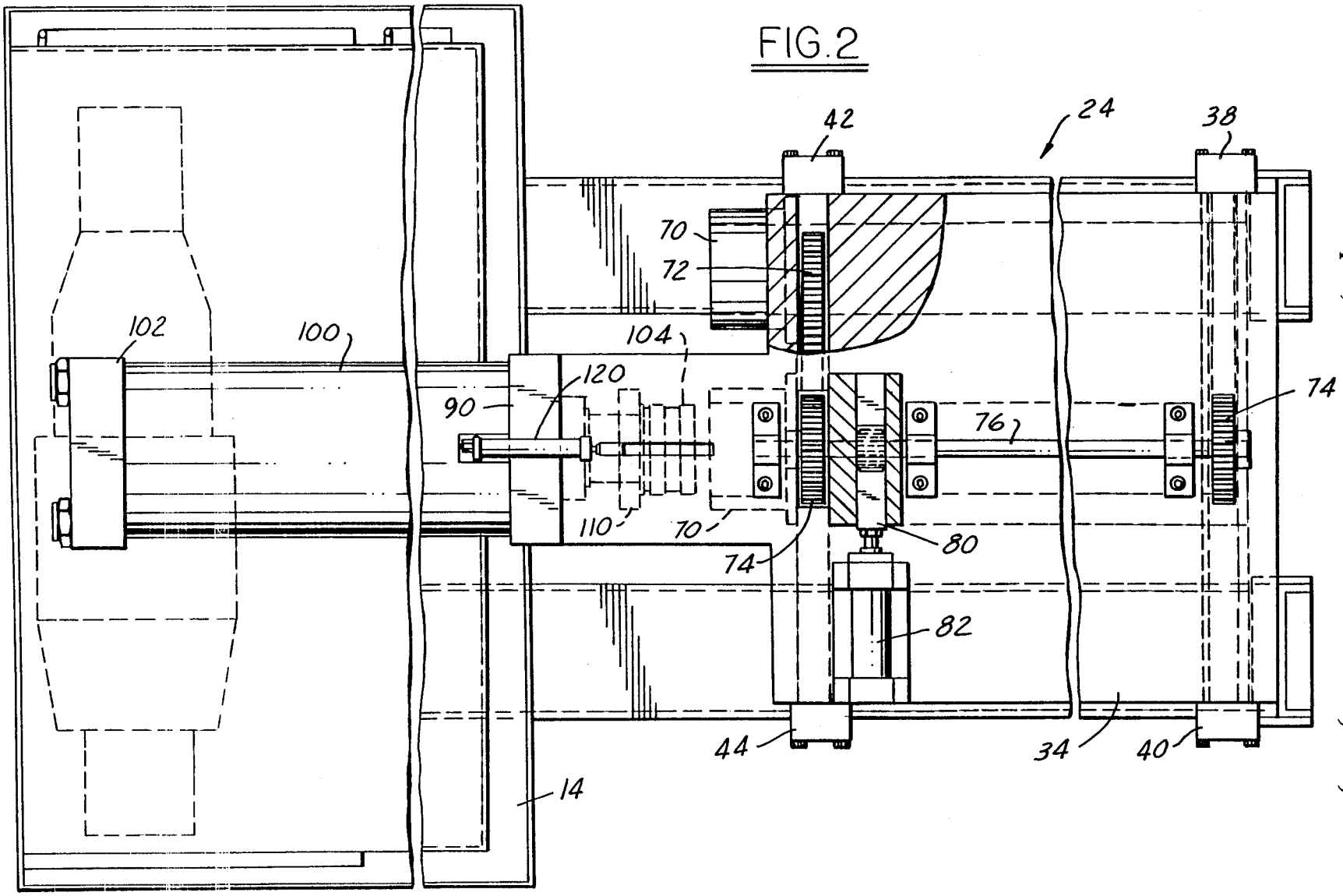
FIG. 2, a plan view of the apparatus of this invention with portions broken away for purposes of illustration.
Figure 3:
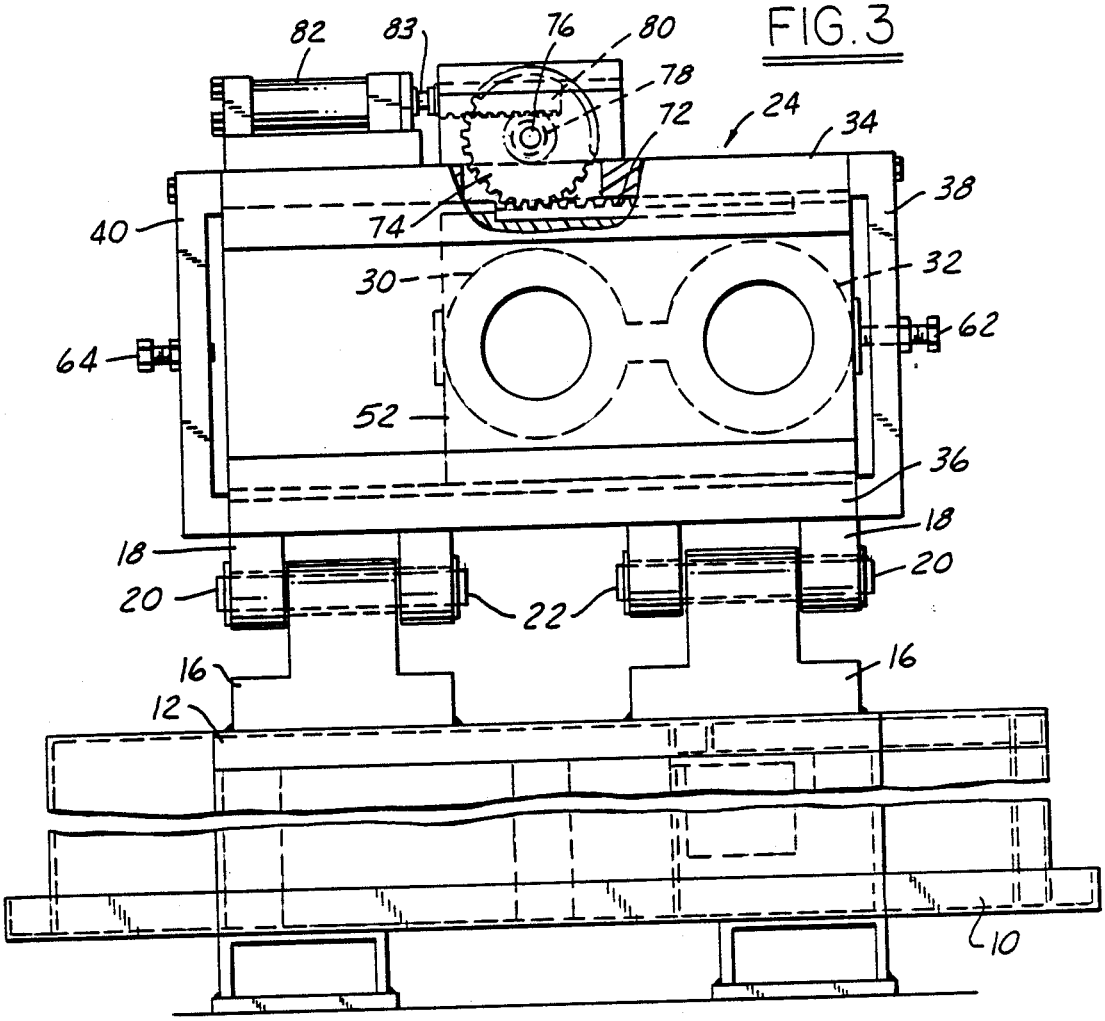
FIG. 3, a front elevational view of the apparatus of this invention with portions broken away for purposes of illustration.

A composite pivoted structure 24 carrying two material cylinders 30, 32 is made up of two spaced guide plates, an upper guide plate 34 and a lower guide plate 36, connected by spaced pairs of tie bars 38, 40 and 42, 44, solidly bolted to the guide plates 34, 36 (FIGS. 2 and 3).

The two cylinders 30, 32 are slidably mounted within the rectangular structure composed of the guide plates 34, 36 and the tie bars 38, 40 and 42, 44. The cylinders are mounted by interfitting end rims (not shown) in transverse front and rear cap plates or mounting plates 50, 52 which extend beyond the cylinders and flanges which interfit into spaced slots 54, 56 at the rear and 58, 60 at the front of the guide plates 34, 36.

The slots 54, 56 and 58, 60 and the guide plates 34, 36 serve as slide tracks for the front and rear cap plates 50, 52. Accordingly, the cap plates and the cylinders mounted thereon can move transversely from the position shown in FIG. 4 to the extreme right position, shown in FIG. 3. Accordingly, in the position shown in FIG. 4 the cylinder 32 is in a central position and in the shifted position of FIG. 3 the cylinder 30 would be in central position as shown in FIG. 3. Adjustable alignment stops 62, 64 on the tie bars 38, 40 and 42, 44 are provided for proper center positioning of the cylinders in their respective positions. On the rear end plate 50 (FIGS. 1 and 4) are mounted by circumferentially spaced bolts de-airing cap rings 70, each of which has a bore aligned with the bores respectively of the material cylinders 30, 32. These function as de-airing devices as will be described. The lateral movement of the front and rear end cap plates 50, 52 is accomplished by a spaced rack and pinion mechanism at the top of the plates. A rack 72 on each of the cap plates cooperates with a pinion gear 74 mounted on axle 76. Also on the axle is a smaller pinion gear 78 actuated by a rack 80 driven by a piston cylinder drive 82 in a suitably timed sequence.

Connecting the lower end of the guide plates 34, 36 is a cross plate 90 bolted securely to the guide plates by bolts 92. This cross plate supports an extrusion cylinder 100 having a cylinder head 102 bolted and sealed thereto. A piston (not shown) within the cylinder 100 has a ram head 104 on a piston rod 106. The ram head 104 is of standard construction with double seals. Pumps P in housing 14 deliver pressure alternately to the respective ends of the cylinder 100 to reciprocate the ram 104. These pumps include a high pressure ram pump and a low pressure high volume pump for retraction.

The cross plate 90 also is associated with a de-airing plate 110 which has extensions 112, 114 which move in slots 116 in guide plates 34, 36. The extensions 112, 114 are connected to spaced power piston cylinders 120.

The function of the de-airing plate 110 will be described below.

Power mechanism is provided to shift the cylinder assembly 24 from a horizontal position as shown in FIG. 1 to a generally vertical position. An elevator piston cylinder combination 130 has a base end pivoted on bracket 132 in base 10. A piston rod 133 is connected to a piston rod clevis 134 pivoted at 136 to a bracket 138 on the lower guide plate 36. A suitable pressure system is provided to direct pressure to the cylinder 130 to elevate or lower the extrusion cylinder assembly 24.

IN THE OPERATION, a safety and automatic control system interlock is provided. This will be described although the switches, signal lights, safety doors and palm buttons are not illustrated. These features are commonly known in the industry. First, an operator must manually load extrusion material into material cylinder 32 shown in the right-hand position in FIG. 3. Then all safety doors are closed by the operator. Then the cylinder 32 is shifted by the piston 82 to the left-hand position shown in FIG. 4 so that cylinder 32 is in a central and ram position. The shot pin cylinder 140 are actuated and the de-airing plate is positioned by the cylinders 120.

The automatic switch is turned on and an automatic button actuated. When all conditions are correct, the automatic circuit will lock in. Thus, the alignment phase has been accomplished. The second phase is de-airing, the third phase, the extrusion phase, and the fourth phase, the retraction phase.

Upon pushing of the palm buttons, the ram head 104 and the de-airing plate 110 are advanced to the de-airing position. The extrusion piston stops within the de-airing ring 70 and the vacuum pump VP is started. When the desired vacuum is reached, the vacuum timer is actuated. When the schedule vacuum phase is complete, ram head 104 advances at extrusion speed and an extrusion timer is started. After a scheduled time, a ready-to-load light can be illuminated and the operator can open the door leading to the cylinder 30 and load the cylinder 30, after which the door is closed and the palm buttons are actuated to cancel the ready-to-load light.

When the ram 104 reaches the end of the extrusion stroke in cylinder 32, the extrusion stops, the vacuum pump is turned off, and, if all safety doors are closed, the extrusion cylinder will retract at maximum speed by operation of the low pressure, high volume pump. Once the extrusion ram is fully retracted, a limit switch will cause retraction of the shot pin cylinder 140 and in an automatic cycle, the index piston-cylinder 82 will shift the full material cylinder into place. Next, the shot pin will be extended and the next cycle will be initiated.

If the extrusion ram cycle is completed before the operator has closed the door at the reloading area, the retraction of the extrusion ram will be delayed until the loading door is closed and the palm buttons energized.

Figure 4:
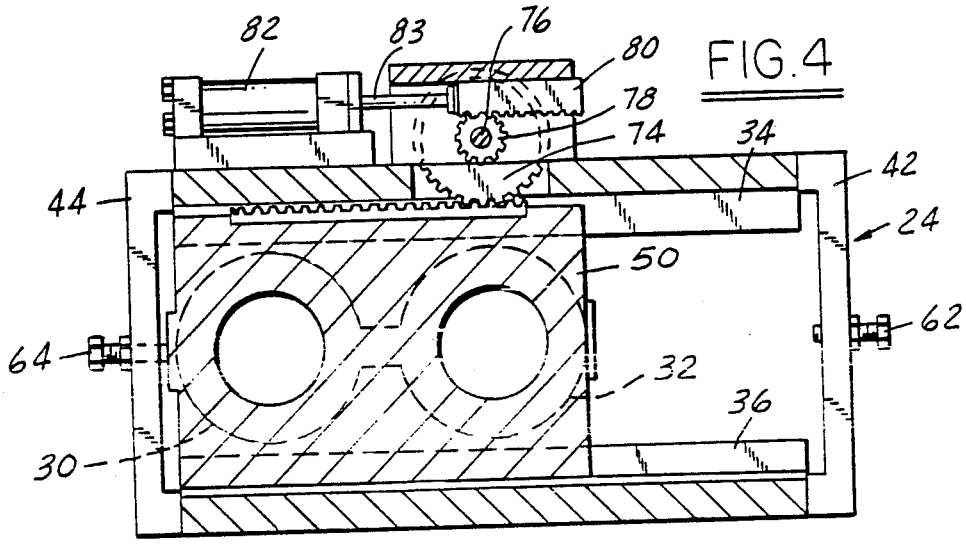
FIG. 4, a fragmentary sectional view taken along line 4—4 in FIG. 1.

At the onset of the alignment phase, piston-cylinder drive 82 is actuated. As drive 82 extend rod 83, rack 80 imparts angular motion to the pinion gear 78 which rotates the axle 76 and gears 74. The rotation of gears 74 coacts with the racks 72 causing the front and rear end cap plates 34, 36 to slidably traverse to the extreme left position as shown in FIG. 4. This places cylinder 32 in the extrusion position aligned with ram 104. Once in place, the shot pin cylinder 140 drives a shot pin 142 up from the lower guide plate 36 into one of two recesses in the rear end cap plate 50, to hold material cylinder 32 in proper alignment for receiving ram head 104.

During the de-airing phase, the ram head 104 and the de-airing cap plate 110 move in tandem toward the de-airing ring 70. Two air driven power cylinders 120 carry the two extension arms 112, 114 which hold de-airing plate 110 toward the de-airing ring 70. The ram head 104 is advanced forward on piston rod 106 of the extrusion cylinder 100. The ram head 104 is stopped inside the de-airing ring 70 just short of the bore of the material cylinder 32, where the de-airing plate 110 forms a seal with the de-airing ring 70. It is at this time a vacuum pump VP is started to remove air (de-air) from the loaded material cylinder 32. To provide for flow of air from the material cylinder 32 and around the ram head 104, the inner circumference of the de-airing ring 70 is slightly larger than the outer circumference of the ram head 104. Therefore, the vacuum pump VP withdraws air from the material cylinder 32 out around the ram head 104 into passage 150, which is bored into the de-airing cap plate 110 and down through the lower extension arm 112 to a tube which is connected to the vacuum pump located in housing 12.

When the preset vacuum pressure is achieved, the extrusion phase begins. The extrusion cylinder 100 is further actuated and thus pushes the ram head 104 through the material cylinder 32, where a close fit is maintained between the side wall of the material cylinder 32 and the ram head 104. The ram head 104 forces the material out through a die located in the front of the structure.

During both the vacuum and extrusion phases of the cycle an operator can open a side door (not shown) and manually load material into the other material cylinder 30 (FIG. 4) which is in the extreme left position.

When the ram head 104 reaches the end of the extrusion stroke of material cylinder 32, the vacuum pump VP is shut down and the extrusion cylinder 100 stops. Only if all of the doors are closed will the retraction phase begin. Therefore, the operator must be finished loading material into the material cylinder 30 and have closed the side door and actuated the dual palm buttons for the cycle to continue. If all doors are closed, the ram head 104 and the de-airing plate 110 retract fully at maximum speed to their original starting position. Then the shot pin 142 is retracted from the rear end cap plate 50. The next cycle is automatically commenced, the cap plates 34, 36 shift to the right to place the loaded cylinder 30 in line with the ram head 104 (FIG. 3), and the cycle is then repeated as above.

Thus an operator can be loading one cylinder while the material in the other cylinder is being discharged.

The elevation of the cylinder around the pivot axis 22 (pivot mounts 18, 20) by operating of cylinder 130 is under control of the operator. Discharge of extruded material from the cylinder can be directed to a moving conveyor, not shown. The angle of disposition of the cylinders to the conveyor can be adjusted to adapt to the consistency of the extruded material.

As above mentioned, more than one group of cylinders, that is, a plurality of cylinders, can be utilized, such as four or six, depending on the capacity required, with suitable indexing to permit simultaneous loading and extrusion.

As illustrated in FIG. 1, the de-airing sealing plate 110 can be retracted from the ram 104 so that the ram can be readily cleaned between cycles if such is necessary. The retraction allows ready observation to determine if such cleaning is necessary.

What is claimed is:

1. A method of extruding material from a pressure extrusion cylinder which comprises:

(a) providing a plurality of parallel positioned extrusion cylinders each having a loading end and a die end, (b) providing a ram to move material from a loaded cylinder through a die, (c) moving said cylinders to align a first cylinder with said ram and position a second cylinder in a material loading position, (d) removing air from said first cylinder around periphery of said ram and prior to and throughout the entire extrusion phase, (e) extruding material from said first cylinder in a extrusion phase, (f) loading loose material into said second cylinder while said first cylinder is in the extrusion phase, and (g) shifting said cylinders laterally to position said first cylinder in loading phase and said second cylinder in a extrusion position.

2. In an extrusion press, (a) a mounting frame, (b) a plurality of material extrusion cylinders mounted in parallel relation on said frame, each having a loading end and an extrusion end, (c) a power cylinder adjacent the loading end of said cylinder, (d) a ram piston actuated by said power cylinder to enter and extrude material from a loaded extrusion cylinder, (e) cap plates positioned transversely at each end of said plurality of cylinders, (f) guide plates on said frame movable receiving said cap plates, (g) a rack and pinion mechanism on said cap plate, (h) an actuating power cylinder connected to said mechanism to shift said cap plates selectively in said frame to align one cylinder with said ram piston in an extrusion position and to position an adjacent cylinder in a material loading position, and (i) a de-airing mechanism mounted on said frame associated with a vacuum source and movable into a position adjacent the loading end of said extrusion cylinders, said de-airing mechanism comprises of a de-airing ring positioned at the loading end and in alignment with each extrusion cylinder having an internal diameter slightly larger than said ram piston, and a de-airing plate movable on said frame to seal an open end of said de-airing ring, said vacuum source being connected through said de-airing plate to the interior of said de-airing ring to exhaust air from a loaded cylinder around the periphery of said ram piston prior to and throughout the entire extrusion stroke, whereby one or more of said extrusion cylinders can be loaded with extrusion material while another is operative in an extrusion phase.

3. An extrusion press as defined in claim 2 in which lateral extensions are positioned on said de-airing plate slidably mounted in said frame and power extensible means on said frame selectively to advance said extensions and said de-airing plate to a de-airing position adjacent said de-airing ring.

* * * * *